United States Patent [19]

Christine

[11] 4,452,378

[45] Jun. 5, 1984

[54] GUSSETTED BOTTOM POUCH

[75] Inventor: William C. Christine, Catasauqua, Pa.

[73] Assignee: Trinity Associates, Nazareth, Pa.

[21] Appl. No.: 389,099

[22] Filed: Jun. 16, 1982

[51] Int. Cl.[3] ..... B65D 30/10

[52] U.S. Cl. ..... 222/107; 222/462; 383/125; 383/906

[58] Field of Search ..... 383/36, 124, 125, 109, 383/906; 222/92, 107, 462, 529, 185

[56] References Cited

U.S. PATENT DOCUMENTS

| | | | |
|---|---|---|---|
| 2,947,653 | 8/1960 | Fohr | 222/107 |
| 3,128,913 | 4/1964 | Specketer | 222/107 |
| 3,559,847 | 2/1971 | Goodrich | 222/107 |
| 3,746,215 | 7/1973 | Ausnit et al. | 222/92 |
| 3,913,789 | 10/1975 | Miller | 222/107 |
| 4,023,607 | 5/1977 | Jensen et al. | 383/906 |
| 4,088,166 | 5/1978 | Miller | 222/107 |
| 4,090,541 | 5/1978 | Cammarata et al. | 222/107 |
| 4,394,936 | 7/1983 | Shavit | 222/92 |

FOREIGN PATENT DOCUMENTS

| | | | |
|---|---|---|---|
| 1327875 | 4/1963 | France | 222/107 |

*Primary Examiner*—H. Grant Skaggs
*Attorney, Agent, or Firm*—Sherman Levy

[57] ABSTRACT

A pouch which is formed to provide an inwardly folded bottom wall to which a discharge fitment is attached so that the weight of the fluidic material within the pouch causes the bottom wall to be extended when the pouch is disposed in a generally vertical configuration to provide a funnel by which all of the contents of the pouch may be discharged.

1 Claim, 6 Drawing Figures

Fig. 1
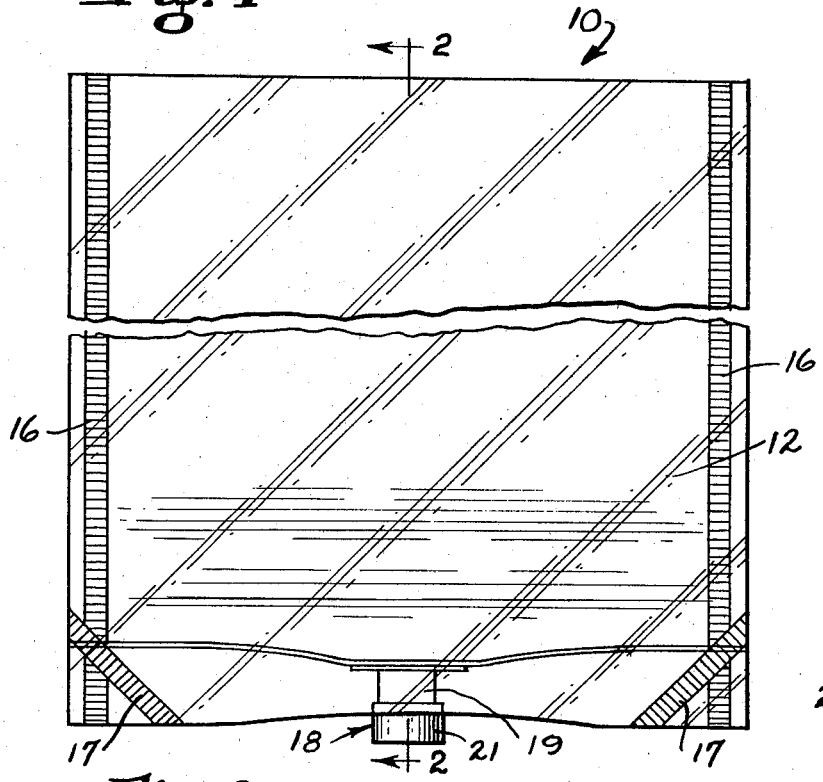
Fig. 2
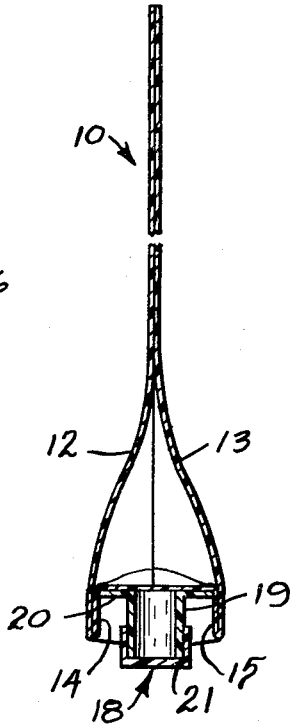
Fig. 3
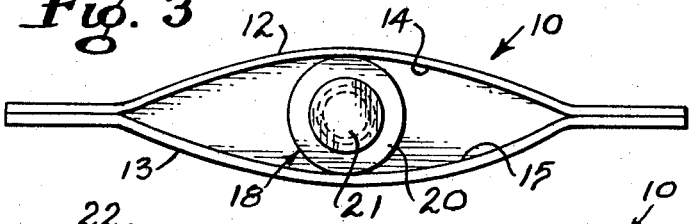
Fig. 6
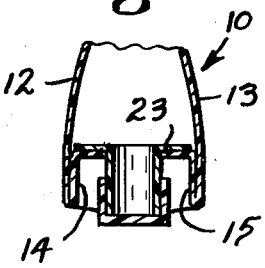
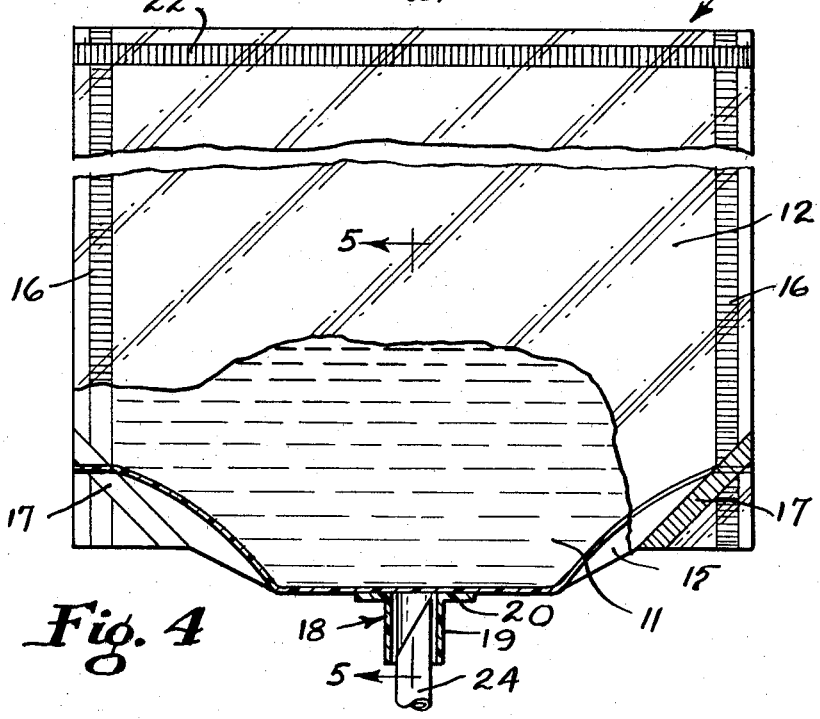
Fig. 4
Fig. 5
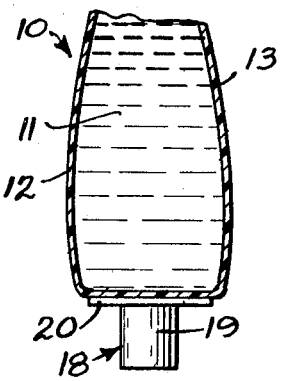

GUSSETTED BOTTOM POUCH

BACKGROUND OF THE INVENTION

Heretofore, the art of making pouch packages for the packaging and preservation of various commodities including comestibles, medicinal preparations and the like in a fluent state is well established. Pouches having two or more side seals have been made using single layer or multi-layer films with contiguous faces that adhere or bond to each other when subjected to pressure and energy such as heat, ultrasonic or radio frequencies that induce molecular bonds between materials of like or similar molecular structure.

In some instances, the pouch has been provided with a fitment through which the contents may be introduced into or discharged therefrom when desired. Some of these fitments have been attached to the outer surface of a wall of the pouch without penetrating such wall so that the freshness and purity of the contents are preserved until the wall in the central portion of the fitment is punctured when dispensing is desired. This creates a pouch which must be filled through an open side prior to completion of the sealing of the pouch. Other fitments have been attached to the inner surface of the wall of the pouch with a tubular portion extending through an opening in such wall. This creates a pouch with a fitment that may be used for either filling or draining the pouch. The contents of the pouch then are protected by a closure member that is threaded, snapped, or frictionally attached to the tubular portion of the fitment. Some examples of these types of pouches are disclosed in my previous U.S. Pat. Nos. 3,894,381 and 4,246,062; as well as the U.S. Pat. Nos. to Welch, Jr., 2,850,422; Andelin, 2,999,387; Swartz, 3,244,576; Anderson, 3,554,256; Waage, 3,642,047; Difiglio, 3,994,412; and Vcelka, 4,049,034.

In other instances, the pouch has been provided with a discharge spout which has been laid between the walls of the pouch when the pouch is being formed so that the spout is adhered or bonded to the pouch during the forming stage and provides communication between the interior and exterior of the pouch. Some examples of this type of structure are disclosed in the U.S. Pat. Nos. to Jinkens, et al, 3,237,624; Lambert, 3,331,421; Aquettant, et al, 4,010,786; Winchell, 4,068,696; Bishop, 4,114,669; Smith, et al, 4,126,167; Mouwen, 4,235,233; and Kneutter, 2,265,075.

Additionally, some thermoplastic bags or containers have been provided with at least one gusset formed therein so that the container has a generally flat bottom wall when in use. Some examples of this type of structure are disclosed in the U.S. Pat. Nos. 3,534,520 to Moran, and Johnson, et al, 3,855,907.

FIELD OF THE INVENTION

This invention relates generally to packages that contain fluent material which may be dispensed when desired and relates particularly to flexible thermoplastic pouches to which a fitment or discharge assistant is attached in a position to promote substantially complete drainage of the contents from the pouch.

DISCLOSURE OF THE INVENTION

The present invention is embodied in a flexible thermoplastic pouch or container for fluent material in which the bottom portion of the pouch has a reversely folded portion which is spread apart to receive a fitment. The sides of the pouch are sealed in a manner to include the reversely folded portion and the top of the pouch is sealed after the contents have been introduced into the pouch. Additionally, the lower portion of the pouch may be provided with angularly disposed seals or fins which extend from the sides of the pouch downwardly and inwardly to the bottom thereof normally to retain the reversely folded portion within the confines of the side of the pouch but which assist in the formation of a funnel when the pouch is disposed in a vertical position and the weight of the contents causes the reversely folded portion to extend outwardly of the side walls of the pouch to promote substantially complete drainage of the contents of the pouch.

It is an object of the invention to provide a flexible pouch for fluent material in which such pouch includes a reversely folded portion to which a fitment is attached and which forms a funnel effect for complete drainage when desired.

BRIEF DESCRIPTION OF THE DRAWINGS

FIG. 1 is a fragmentary side elevational view of a pouch prior to being filled with fluent material.

FIG. 2 is a sectional view taken on the line 2—2 of FIG. 1.

FIG. 3 is a bottom plan view thereof.

FIG. 4 is a fragmentary side elevational view of a filled pouch which is disposed in a generally vertical position.

FIG. 5 is a sectional view taken on the line 5—5 of FIG. 4.

FIG. 6 is a fragmentary sectional view similar to FIG. 2 and illustrating another embodiment of the invention.

DESCRIPTION OF THE PREFERRED EMBODIMENT

With continued reference to the drawings, a pouch or container 10 is provided for the packaging and dispensing of fluent material 11 such as comestibles, medicinal preparations, petroleum products including oil, grease, or the like. The pouch normally is constructed of flexible sealable thermoplastic film material which may be clear and transparent or may be of any desired color and have ultra violet and other inhibitors incorporated therein. The pouch may be manufactured in a conventional vertical form/fill/seal machine or a horizontal form/fill/seal machine (not shown). Preferably, the pouch or container is constructed of a unitary strip of film material which has been folded to a desired configuration; however, it is contemplated that the pouch could be constructed of several individual pieces which are sealed together.

The pouch includes generally flat, elongated front and rear walls 12 and 13 respectively which have integral reversely folded walls 14 and 15 at the lower end thereof. The front and rear walls are bonded together along both sides by seams or fins 16 which extend the full length of the pouch 10. At the lower portion of the pouch, the seams 16 bond the facing surfaces of the walls 14 and 15 together and bond the edges of the front and rear walls 12 and 13 to the reversely folded walls 14 and 15. Additionally, an angularly disposed seam or fin 17 extends from each side of the pouch downwardly and inwardly to the bottom to provide a further bond for the reversely folded walls 14 and 15 and the front and rear walls 12 and 13. At this point the top of the pouch remains open.

After the basic pouch or container has been formed, such pouch is opened and the central portions of the reversely folded walls 14 and 15 are spread apart. A fitment 18 having a tubular portion 19 and a sealing flange 20 is inserted between the side walls and against a flattened intermediate portion of the walls 14 and 15. Thereafter, the sealing flange 20 is bonded to the intermediate portion by heat and pressure in any desired manner (not shown), such as by extending a backing element downwardly through the pouch and applying heat and pressure to the exterior of the sealing flange 20. As illustrated in FIGS. 1–5, the walls 14 and 15 remain imperforate so that the contents of the pouch which are subsequently added are not discharged accidentally. If desired, a cap 21 which functions as an auxiliary closure member may be threaded, snapped or otherwise attached to the end of the tubular portion 19 remote from the flange 20. With particular reference to FIGS. 1–3, it is apparent that at least a portion of the fitment 18 is positioned within the confines of the front and rear walls 12 and 13.

When the pouch has been formed, a predetermined volume of fluent material 11 is introduced into such pouch in any desired manner after which a top seam or fin 22 is applied to the top to completely close the pouch. During the time that the fluent material 11 is being introduced into the pouch, it is preferred that the bottom of the pouch, including the reversely folded walls 14 and 15, be supported so that the weight of the fluent material does not cause the bottom to be extended. Due to the flexibility of the material of the pouch, the side walls 12 and 13 may bulge outwardly as clearly shown in FIG. 5. Normally, during storage, the pouch is retained within a protective box or carton to prevent inadvertent puncturing of the pouch.

With particular reference to FIG. 6, another embodiment of the invention is illustrated. In this embodiment, the central portion of the reversely folded walls 14 and 15 is provided with an opening 23 through which the tubular portion of the fitment 18 extends. The sealing flange 20 is bonded to the inner surface of the walls 14 and 15. In this embodiment, the fluent material 11 may be introduced into the pouch through the tubular portion 19 of the fitment. In this case, the cap 21 becomes the primary closure member which prevents dispensing of the fluent material until the cap is removed.

In the operation of the device, when it is desired to dispense the contents of the pouch 10, such pouch is removed from the protective box and is suspended in a generally vertical position. This causes the weight of the contents to be applied to the bottom of the pouch which causes the intermediate portions of the reversely folded walls to move outwardly as shown in FIGS. 4 and 5. However, the angularly disposed seams 17 prevent the extremities of the reversely folded walls from moving and, therefore, such walls together with the lower portions of the front and rear walls 12 and 13 define a funnel which channels the fluent material 11 to the fitment 18. In order to discharge such material from the pouch, a knife or other sharp instrument 24 is inserted through the tubular portion 19 of the fitment to pierce the pouch so that the fluent material flows by gravity through the fitment or the pouch may be squeezed to cause the material to flow, depending upon the viscosity of the material. If desired, a portion of the contents may be discharged after which the cap 21 may be applied to the fitment to substantially prevent further discharge until the cap is removed.

It is apparent that in the embodiment shown in FIG. 6, the material may be dispensed merely by removing the cap 21 after the pouch has been placed in a generally vertical position. Further, it is noted that a valve or other flow control member (not shown) may be attached to the fitment 18 to regulate the flow of the fluent material.

The present invention can be used for holding any type of fluidic material, and the gussetted bottom pouch is rugged in construction and fool proof in use and can be efficiently made and utilized and wherein the gussetted bottom pouch is generally inexpensive to manufacture and to utilize. The fluidic material in the bag can be of any desired type including wine, and wherein the fluidic material can also include any desired material which is to be held and dispensed. The gussetted bottom pouch provides a convenient location on which to place fitments, and the construction assures complete drainage which previous such devices did not permit.

A fitment can be used which has been scored so that normal pressure of squeezing the bag will force open the fitment so as to provide a dispensing fitment. Such a fitment may be made of plastic having a memory so that when open it will return to the original position thereby providing a self-closing mechanism. The gussetted bottom pouch is relatively easy and inexpensive to manufacture, and wherein fitments can be placed on unbroken membranes, and the contents can be maintained in a sterile condition. Further, the advantage of a rigid box can be assured plus flexibility. When dispensing the contents, air cannot enter the interior of the pouch so spoilage of the fluidic material within the pouch will be prevented.

Some of the advantages of the present invention are that it can be made of a polymeric material including polyethylene or polymeric film with polyethylene coating, or polypropylene and such materials are heat sealable, or ultrasonics can be used. There is provided a gussetted pouch with a fitment on the gusset, and there is a bottom gussetted member. Some of the advantages of the present invention are that the gussetted bottom pouch can be used for packages which can be used as liners in boxes; pouring or dispensing means can be utilized having a tap or control valve with fluidic material which can be extruded from the pouch, and the pouch can also be used as a drainage member as in medical pouches. Dispensing in various ways from a box or rigid contained can be utilized.

The angularly disposed seam or fin is not essential to the invention. In small pouches it is never used; in large pouches with thin wall material it is helpful, perhaps necessary. Thus, the angular seal is an option with the present invention.

With the present invention there is no air contaminating the contents, and the pouch is also inexpensive; and wherein the pouch can be filled and used with fitments and the pouch can be drained completely due to the bottom fitment.

While several embodiments of the present invention have been illustrated herein in particular detail, it will be understood that variations and modifications may be effected without departing from the spirit and scope of the novel concepts of this invention.

What is claimed and desired to be secured by U.S. Letters Patent is:

1. A flexible pouch for storing and dispensing fluent material consisting solely of a first pair of walls, a second pair of walls connected to and being reversely folded relative to said first pair of walls, said second pair of walls being connected together along contiguous edges, first sealing means for sealing the edge portions of said first pair of walls together, fitment means sealingly connected to said second pair of walls, and fluent material contained within said pouch, whereby the weight of the fluent material causes said second pair of walls to be extended downwardly and to form a funnel when said pouch is in a generally vertical position so that substantially all of the fluent material may be discharged from said pouch through said fitment means, said first and second pairs of walls being folded from a unitary strip of material, said first and second pairs of walls being constructed of plastic material, and second sealing means disposed in angular relationship with said first sealing means and sealing portions of said second pair of walls together and sealing portions of said first pair of walls to portions of said second pair of walls.

* * * * *